United States Patent [19]

Forbes

[11] 4,116,445

[45] Sep. 26, 1978

[54] THOUGHT DYNAMICS GAME

[76] Inventor: Gerald Forbes, 11515 Wood St., Maple Ridge, British Columbia, Canada

[21] Appl. No.: 795,232

[22] Filed: Aug. 22, 1977

[51] Int. Cl.[2] ..... A63F 9/18

[52] U.S. Cl. ..... 273/161; 46/236

[58] Field of Search ..... 273/161; 46/236, 238

[56] References Cited

U.S. PATENT DOCUMENTS

| | | | |
|---|---|---|---|
| 1,514,260 | 11/1924 | Rees | 273/161 |
| 3,307,850 | 3/1967 | Thomas | 273/161 |
| 3,478,466 | 11/1969 | Conner | 46/236 |
| 3,707,290 | 12/1972 | Birnkrant | 273/161 |

*Primary Examiner*—Anton O. Oechsle

[57] ABSTRACT

Game of thought dynamics comprising a game board inscribed with central intersecting horizontal, vertical, and diagonal lines and with a plurality of concentric circles emanating from the point of intersection, a removable magnet provided in the center of the board at the point of intersection, and a lead pendulum element suspendible from an elongated support over the center of the board in a manner such that said pendulum element is free to swing in any linear or circular direction consistent with the inscribed lines when supported by means of a player holding the free end of the elongated support.

1 Claim, 4 Drawing Figures

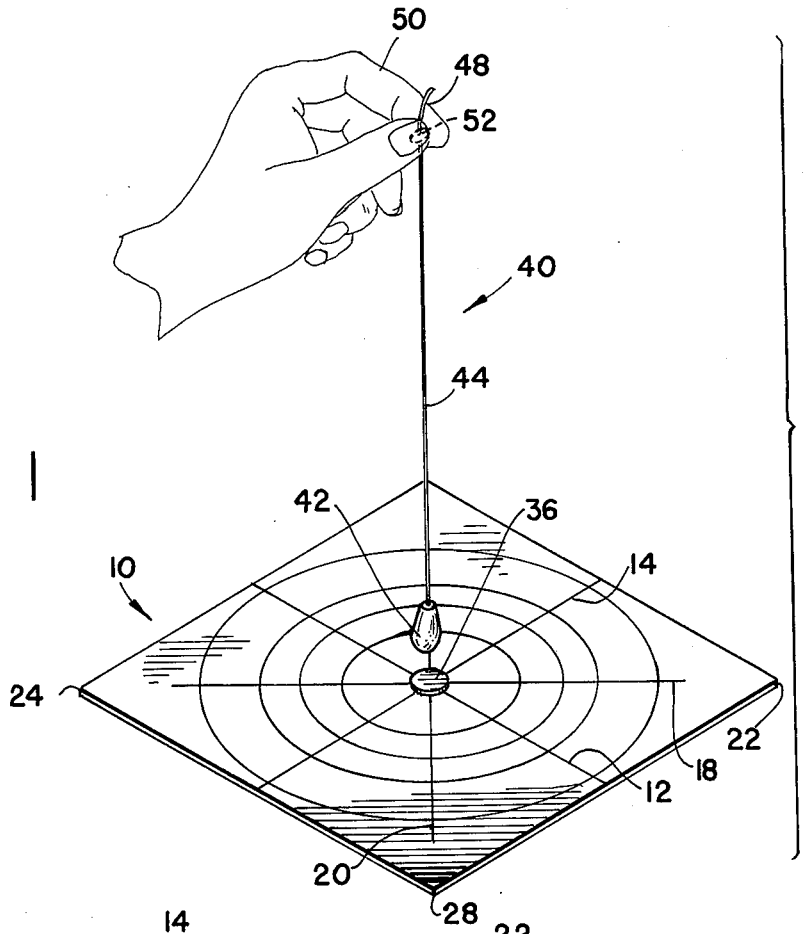
FIG. 1
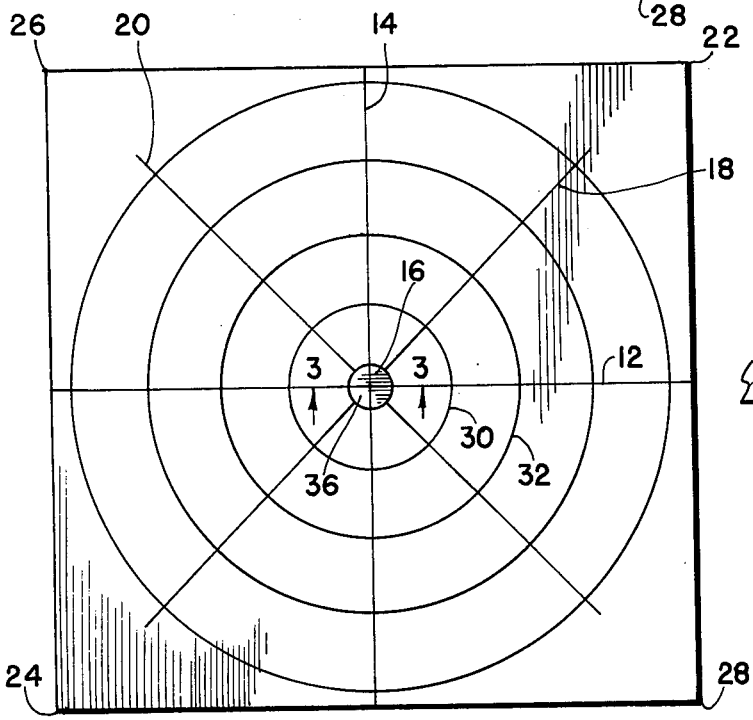
FIG. 2
FIG. 3
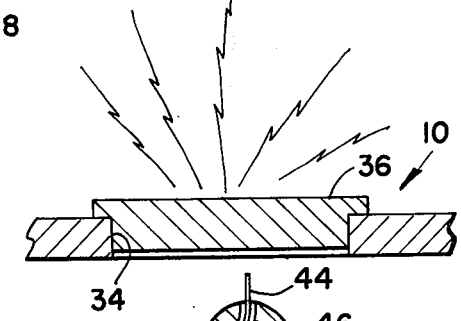
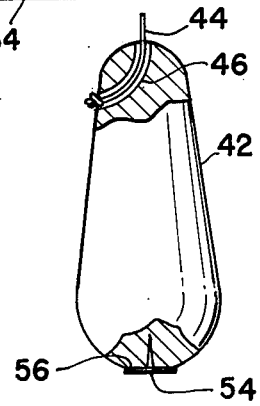
FIG. 4

THOUGHT DYNAMICS GAME

BACKGROUND OF THE INVENTION

1. Field of the Invention

This invention relates to amusement devices and particularly to a game involving thought dynamics.

2. Description of the Prior Art

The control of mind over matter has always been of great interest to man. Witness the popularity of seances, mediums and fortune tellers. A number of amusement devices for practicing psychic communication may be found in U.S. Pat. Nos. 1,548,482; 1,637,010; 1,514,260; 3,249,357; 3,307,849; 3,307,850; 3,417,997; and 3,707,290, merely to name a few. The foregoing, however, do not disclose the present invention wherein a pendulum is suspendible over a removable magnet on a game board and a swinging force induced, and then the magnet is removed, and the player induces the swinging force by thought dynamics.

SUMMARY OF THE INVENTION

It is, therefore, among one of the principal objectives to provide a simple, yet extremely interesting and amusing thought control game.

In accord with the invention there is now provided a game of thought dymanics which comprises a game board inscribed with central intersecting horizontal, vertical and diagonal lines, and with a plurality of spaced, concentric circles radiating from the point of intersection, a removable magnet providable in the center of the board at the aforesaid point of intersection, and a lead pendulum element or the like suspendible from an elongated support over the center of the board in a manner such that the pendulum element is free to swing in any linear or circular direction consistent with the inscribed lines serving as thought guides when supported by a player holding the free end of the elongated support. The magnet is used to introduce the player to the game by inducing a swinging magnetic force to the lead pendulum, then the magnet is removed and the player induces the moving force by thought dynamics.

BRIEF DESCRIPTION OF THE DRAWING

The invention will be hereinafter more fully described with reference to the accompanying drawing in which:

FIG. 1 is a view in perspective of the game board, pendulum element, and player's hand playing the game;

FIG. 2 is a plan view of the game board;

FIG. 3 is a sectional view taken along line 3—3 of FIG. 2; and

FIG. 4 is an elevated view of the pendulum element.

DESCRIPTION OF THE PREFERRED EMBODIMENTS

Referring now to the figures of the drawing, there is illustrated therein a game board 10, about 12 × 12 inches in size but this size can vary. Game board 10 is inscribed with horizontal and vertically intersecting lines 12 and 14, respectively, which run from border to border of the board. Lines 12 and 14 intersect at the center point 16 of the board. Diagonal lines 18 and 20, extending in the direction of the corners 22, 24 and 26, 28, respectively, of the board, are also inscribed thereon, and also interset at center point 16.

Further, a plurality of equally spaced concentric circles 30, 32, etc., are inscribed on board 10 and emanating from the point of intersection 16.

A central circular slot 34 is provided on the game board 10 into which a circular magnet 36, having a T-shaped cross-section, is removably insertable.

A pendulum element 40 is utilized with the game which comprises a lead weight 42, or the like, and is suspendible from an elongated support member 44, attached at one end 46 to the lead weight 42 and at the other end 48 is manually holdable by the fingers 50 of a player. A small bead 52 at end 48 can help the player to hold the support member. Support member 44 is about 10 to 12 inches long and is formed of nylon fighting line or the like. The head 54 of a soft iron thumb tack-like material is bonded to the lower end 50 of eight 42, as at 56.

In order to play the game, initially the magnet 36 is inserted into slot 34, and the lead weight 42 is suspended slightly above and slightly in front of the magnet. The pendulum element is held between the fingers with the elbows on the playing table. When the force of the magnet is just felt by the lead weight via the attraction of soft iron 54 therefor, the same wil swing towards the magnet. The player then slowly moves the lead weight away from the magnet and the weight begins to swing in that direction. The player exerts his thought processes on this swing and as the lead weight is moved further and further back, the swing of the pendulum becomes greater. When the player has become acquainted with the feel of the pendulum swing, the magnet 36 is removed and the game resumed. By the use of thought dynamics, even without the magnet, by holding the pendulum and its soft iron tipped weight above the center point 16 of the board, the pendulum can be made to swing in any direction using the inscribed lines 12, 14, 18, 20, 30, and 32, etc., as thought guides. Thus the pendulum can be made to swing vertically, horizontally, diagonally, and circularly, in any direction.

The game is of such simple construction that it can be produced very cheaply, yet it can supply enormous fun to the players.

What is claimed is:

1. A game of thought dynamics which comprises a game board having parallel opposing sides and ends and inscribed with intersecting horizontal, vertical and diagonal lines, all of said lines intersecting at a center point on said game board, a plurality of spaced, concentric circles also inscribed on said game board radiating from said center point, a removable magnet provided in the center of said board overlying said center point, and a pendulum weighted element suspendible from an elongated support over said center point in a manner such that said weighted element is free to swing in any linear or circular direction consistent with said inscribed lines, said inscribed lines serving as thought guides, when supported by a player holding the free end of said elongated support, wherein said weighted element is formed of lead, and wherein the lower end of said lead weighted element has a minor amount of soft iron bonded thereto.

* * * * *